US006302619B2

(12) United States Patent
Fix

(10) Patent No.: US 6,302,619 B2
(45) Date of Patent: Oct. 16, 2001

(54) POWERED INERTIA PROPELLED SCREED APPARATUS

(76) Inventor: Jerald P. Fix, 1810 W. Latham La., Peoria, IL (US) 61614

( * ) Notice: Subject to any disclaimer, the term of this patent is extended or adjusted under 35 U.S.C. 154(b) by 0 days.

(21) Appl. No.: 09/747,916

(22) Filed: Dec. 22, 2000

Related U.S. Application Data

(63) Continuation-in-part of application No. 09/256,904, filed on Feb. 24, 1999, now abandoned.

(51) Int. Cl.[7] ..... E01C 19/22; E01C 19/38

(52) U.S. Cl. ..... 404/84.1; 404/114; 404/118; 404/119; 404/120

(58) Field of Search ..... 404/72, 75, 84.1, 404/114, 118, 119, 120

(56) References Cited

U.S. PATENT DOCUMENTS

| | | | | |
|---|---|---|---|---|
| 1,874,559 | | 8/1932 | Love . | |
| 2,248,247 | * | 7/1941 | Nichols | 404/120 |
| 2,255,343 | * | 9/1941 | Baily | 404/114 |
| 2,372,163 | * | 3/1945 | Whiteman | 404/119 |
| 2,386,662 | * | 10/1945 | Crock | 404/120 |
| 2,400,321 | * | 5/1946 | Troxell | 404/120 |
| 2,449,851 | | 9/1948 | Jackson . | |
| 2,542,979 | | 2/1951 | Barnes . | |
| 2,584,459 | | 2/1952 | Jackson . | |
| 2,599,330 | | 6/1952 | Jackson . | |
| 2,633,782 | | 4/1953 | Clement . | |
| 2,746,367 | | 5/1956 | Ferguson . | |
| 3,412,658 | | 11/1968 | Griffin . | |
| 4,073,593 | | 2/1978 | Storm . | |
| 4,132,492 | * | 1/1979 | Jenkins | 404/119 |
| 4,386,901 | | 6/1983 | Morrison . | |
| 4,427,358 | | 1/1984 | Stilwell . | |
| 4,466,757 | * | 8/1984 | Allen | 404/114 |
| 4,685,826 | * | 8/1987 | Allen | 404/114 |
| 4,741,643 | * | 5/1988 | Allen | 404/114 |
| 4,838,730 | | 6/1989 | Owens . | |
| 5,281,050 | * | 1/1994 | Howard | 404/120 |

* cited by examiner

*Primary Examiner*—Thomas B. Will
*Assistant Examiner*—Gary S. Hartmann
(74) *Attorney, Agent, or Firm*—Husch & Eppenberger, LLC; Robert E. Muir; Richard J. Musgrave

(57) ABSTRACT

A powered inertia propelled screed for leveling, smoothing and spreading concrete having a power source, motor pulley, motor belt, power reduction pulley, power reduction belt, transfer axle, second power reduction pulley, continuous belt, irregular shaped pulley, arm, stationary bracket, platform, wheels, tracks, control arms and screed. The rotation of the irregular shaped pulley causes the powered inertia propelled screed to move back and forth along the tracks by inertia and so that the screed is moved back and forth along the concrete.

8 Claims, 7 Drawing Sheets

POWERED INERTIA PROPELLED SCREED APPARATUS

APPLICATION CROSS-REFERENCES

This application is a continuation-in-part of U.S. application Ser. No. 09/256,904, filed Feb. 24, 1999, now abandoned.

FIELD OF THE INVENTION

This invention relates to an apparatus for screeding concrete, cement, mud, sand, dirt, grain or other similar dry or semi-fluid materials (hereinafter "concrete") and more particularly to a powered inertia propelled screed apparatus for screeding concrete.

It is envisaged that the invention will find application in the field of finished concrete work, more particularly in the field of leveling, smoothing or spreading placed concrete before solidification of same.

DESCRIPTION OF THE RELATED ART

To complete small concrete jobs at home, such as a new driveway, sidewalk or deck, a hand-held screed board is used to level, smooth or spread recently poured or deposited concrete. Heavier particles are forced downward during this process. The user holds the screed board in his hands and pushes and pulls the board across the top of the concrete to level, smooth or spread same. It is also known that by setting up forms, the user is able to obtain a more level and smooth surface. The user extends the hand-held screed board across the forms so that the board is above and across the concrete. The user then moves the board transverse along the forms in a back and forth movement along the forms to level, smooth or spread the concrete. The problem with using a hand-held screed board is that it is labor intensive, difficult to use and requires the user to be in a bending, squatting or kneeling position, which can be uncomfortable.

To level, smooth or spread concrete in larger areas that are beyond the reach of the user, screeding the concrete becomes problematic. Either multiple persons are required to perform the job or the person is required to stand in the concrete while leveling, smoothing or spreading the concrete, which is very messy and difficult. As an alternative, most homeowners hire contractors to complete small concrete jobs, which can be very expensive.

There are machines which have been developed to level, smooth and spread concrete; however, these machines are large, difficult to transport and expensive. Furthermore, using these large machines for small jobs would not be practical. These machines are usually only practical for larger jobs because of the purchase price. These large machines require multiple operators to operate them. In short, these machines are not suitable for small jobs such as driveways, sidewalks and decks. As such, municipalities, street builders and construction companies are usually the only purchasers of these machines.

There are vibrating screed machines and tamping machines available to level, smooth and spread concrete; however, these machines only work well on flat surfaces. If these machines are utilized on a sloping surface, the concrete tends to flow down the slope due to the vibration which results in an undesirable condition.

The present invention is directed to overcoming one or more of the problems set forth above.

SUMMARY OF THE INVENTION

An aspect of the invention is providing a powered inertia propelled screed apparatus for screeding concrete.

In another aspect of the invention there is provided a powered inertia propelled screed apparatus suitable for many different sized jobs.

Yet another aspect of the invention there is provided a powered inertia propelled screed apparatus that utilizes inertia to screed concrete.

Still another aspect of the invention there is provided a powered inertia propelled screed apparatus that is inexpensive to manufacturer.

Another aspect of the invention there is provided a powered inertia propelled screed apparatus that allows one person to screed concrete without much effort.

Yet another aspect of the invention there is provided a powered inertia propelled screed apparatus that is efficient in screeding concrete.

In another aspect of the invention there is provided a powered inertia propelled screed apparatus that is easily controlled and operated.

It is an aspect of the invention there is provided a powered inertia propelled screed apparatus for reducing the amount of time to screed concrete.

It is another aspect of the invention there is provided a powered inertia propelled screed apparatus that is compact and easily transportable from job to job.

Yet another aspect of the invention there is provided a powered inertia propelled screed apparatus that is easily modified to fit the particular size of the area that requires screeding.

Still another aspect of the invention there is provided a powered inertia propelled screed apparatus that can be manufactured with different size power sources depending on the application.

Another aspect of the invention there is provided a powered inertia propelled screed apparatus that can be fitted with different sized screeds depending on the application.

Yet another aspect of the invention there is provided a powered inertia propelled screed apparatus that can be used on non-flat or sloped surfaces producing excellent results.

The above aspects are merely illustrative and should not be construed as all-inclusive. The aspects should not be construed as limiting the scope of the invention rather the scope of the invention is detailed in the appended claims.

BRIEF DESCRIPTION OF THE DRAWINGS:

Reference is now made more particularly to the drawings, which illustrate the best presently known mode of carrying out the invention and wherein similar reference characters indicate the same parts throughout the views.

Figure 1:
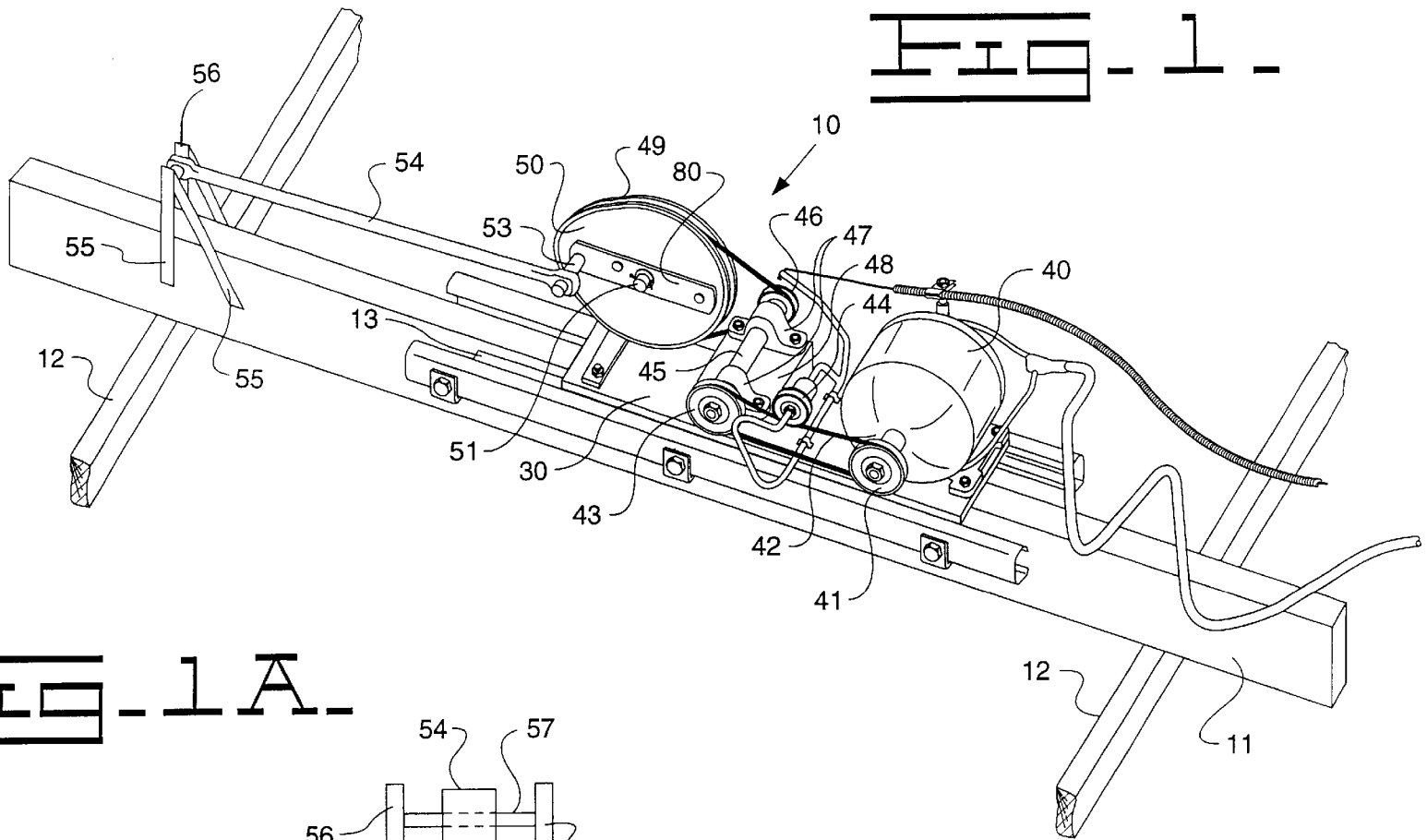
FIG. 1 illustrates a perspective back side view of a powered inertia propelled screed apparatus without control arms attached thereto.

DETAILED DESCRIPTION:

With reference to FIG. 1, a powered inertia propelled screed is illustrated and designated as numeral 10. The powered inertia propelled screed 10 has a screed 11 used to level, smooth and spread concrete. The screed 11 rests on top of forms 12. The screed 11 is transverse to the forms 12 and during operation of the powered inertia propelled screed 10, the screed 11 moves from a first position to a second position or back and forth across the forms 12 transverse with respect to the forms 12. The screed 11 can be made of a wide variety of materials such as metals (e.g., aluminum, steel), plastics, composites, wood or the like; however, in the preferred embodiment, the screed 11 is made of wood because it is less expensive and light weight with respect to other materials. The specific application and size of the work area in which the screed 11 is to be used will dictate the physical characteristics of the screed 11. For most jobs, the screed 11 could be 14 feet in length, 2 inches in width and 6 inches in height. These physical dimensions are not meant to be limiting and may vary tremendously depending on the specific concrete job.

Figure 7:
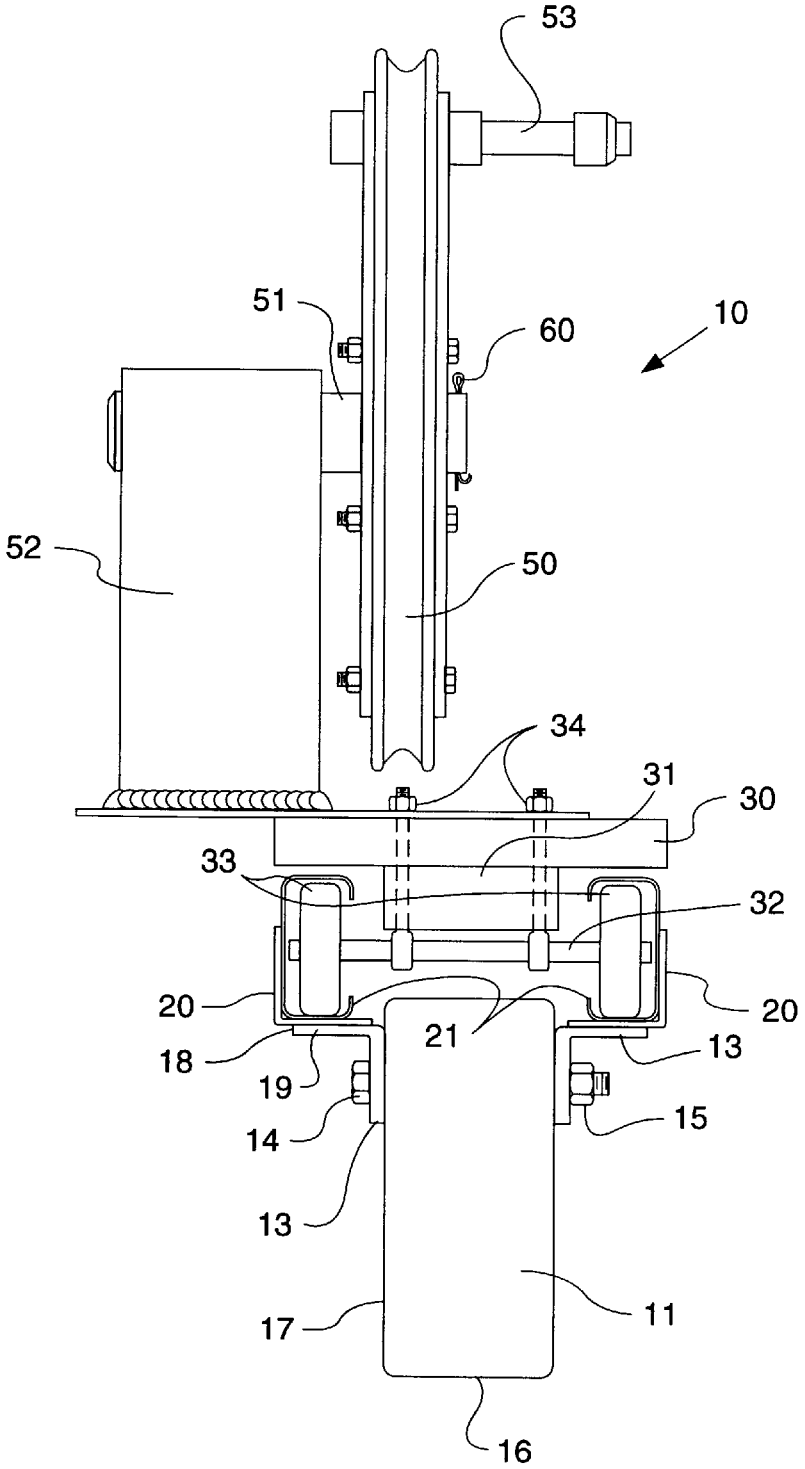
FIG. 7 illustrates a left side view of the powered inertia propelled screed apparatus.

FIG. 7 illustrates the screed 11 connected to a plurality of angle irons 13. The angle irons 13 are mounted to the screed 11 with bolts 14 and nuts 15; however, most fastening means would be acceptable. For example, rivets (not shown), nails (not shown) or clamps (not shown) could be substituted for the bolts 14 and nuts 15. The screed 11 has a bottom 16 which rests on the forms 12. The screed 11 has sides 17 that are mounted to the angle irons 13. The angle irons 13 have first lengths 19, which are, parallel and connected to the sides 17 of the screed 11 and second lengths 18, which are transverse to the sides 17 of the screed 11. The first and second lengths 19, 18 are at substantially right angles with respect to each other. The second lengths 18 are connected to track brackets 20. The track brackets 20 are connected to tracks 21. The tracks 21 are utilized for controlling the movement of the powered inertia propelled screed 10 parallel to the screed 11 and transverse to the forms 12. The tracks 21 are shown as C brackets; however, there are many types of runners or tracks that could be utilized with the powered inertia propelled screed 10.

The powered inertia propelled screed 10 has a platform 30. A spacer 31 is connected to the bottom of the platform 30. Axles 32 are attached to the spacer 31 by spacer bolts 34. The axles 32 have a plurality of wheels 33 attached transverse to the axles 32. The wheels 33 are assembled into or onto the tracks 21. During operation of the powered inertia propelled screed 10, the wheels 33 travel along the tracks 21 in a back and forth motion along the tracks 21.

Referring to FIG. 1, a power source 40 is mounted onto the platform 30 opposite the side connected to the spacer 31. In the preferred embodiment, a motor is utilized. The specifications for the motor can be adapted to the particular job. For example, if a large area is being worked and the screed 11 is required to be longer, the motor's size and horsepower may need to be increased. In the preferred embodiment, the motor has a $\frac{1}{3}^{rd}$ horsepower, 120 voltage alternating current (A.C.) and 1725 revolutions per minute specification when used in conjunction with a 14 feet long, 2 inches wide and 6 inches high screed 11. The power source 40 and screed 11 specifications can be modified according to the particular application. Furthermore, direct current (D.C.) voltage such as a car or truck battery could power a direct current (D.C.) motor. Also, internal combustion engines could be used with the powered inertia propelled screed 10. The power source 40 powers a motor pulley 41 or first pulley. The motor pulley 41 is approximately 2½ inches in diameter. The power source 40 rotates the motor pulley 41 when power is applied to the power source 40. The motor pulley 41 drives a motor belt 42. In the preferred embodiment, the motor belt 42 is a V-belt that is $\frac{3}{4}^{th}$ on an inch wide by 10 inches long. The motor belt 42 is connected to a speed reduction pulley 43 or second pulley. The speed reduction pulley 43 is generally 3½ inches in diameter and accepts the motor belt 42. The speed reduction pulley 43 is rotated by the motor belt 42. Located between the motor pulley 41 and the speed reduction pulley 43 is an idler pulley 44 or fifth pulley, which acts on the motor belt 42. The idler pulley 44 functions as a clutch and is known in the art and no further explanation is required.

A transfer axle 45 is attached at one end to the speed reduction pulley 43. A second speed reduction pulley 46, or third pulley, is connected to the opposite end of the transfer axle 45. The second speed reduction pulley 46 is generally 2¼ inches in diameter and accepts a continuous belt 49 that is typically, but not necessarily, taut. The speed reduction pulley 43 rotates and transfers rotation through the transfer axle 45 to the second speed reduction pulley 46. The transfer axle 45 is connected to a plurality of pillow block bearings 47 and is mounted to an elevation block 48. The elevation block 48 is connected to the platform 30 on the side opposite the side of the platform connected to the elevation block 48.

Figure 2:
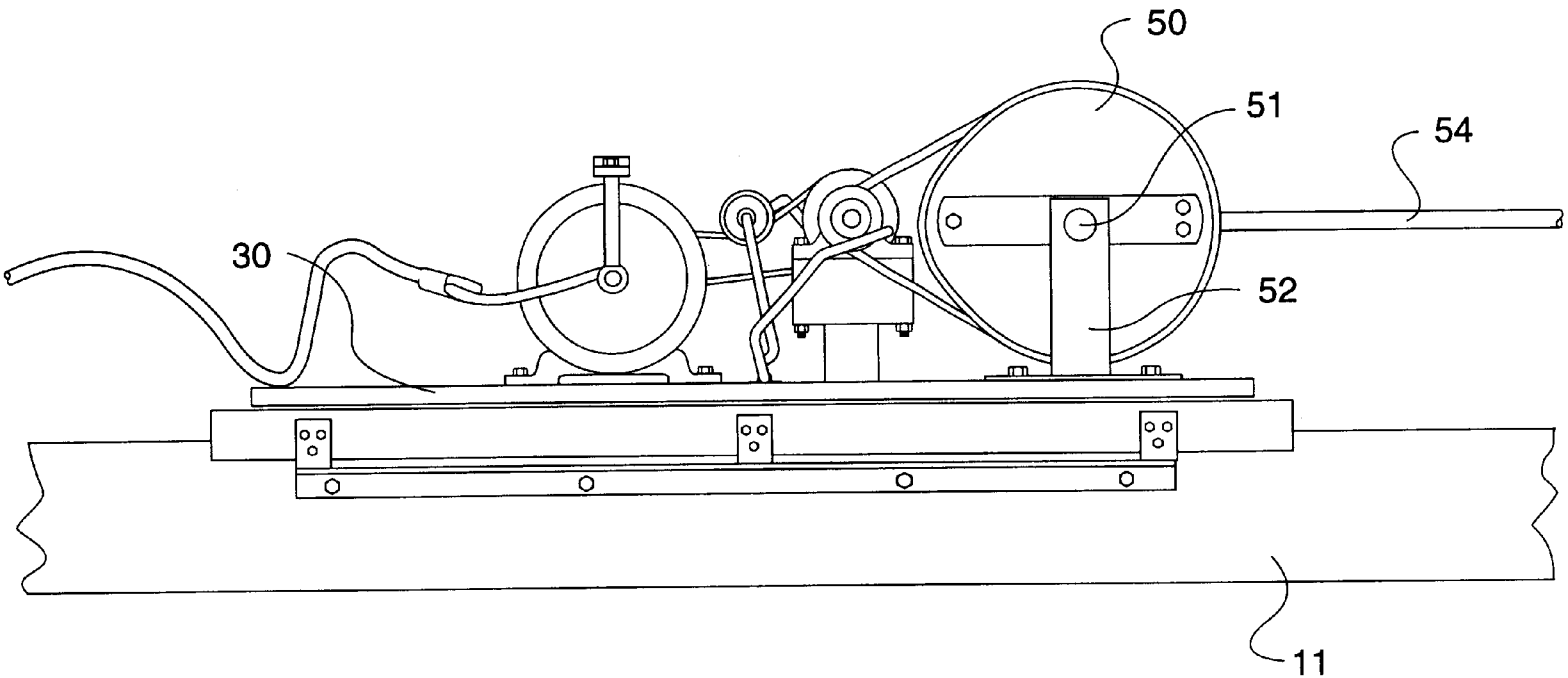
FIG. 2 illustrates a perspective front side view of the powered inertia propelled screed apparatus without control arms attached thereto.

The speed reduction pulley 43 rotates and transfer rotation to the second speed reduction pulley 46. The second speed reduction pulley 46 rotates the continuous belt 49. It is obvious to those in the art that a transmission (not shown) or other means for reducing speed could be utilized instead of the preferred embodiment which includes the speed reduction pulley 43, the transfer axle 45, and the second speed reduction pulley 46. The continuous belt 49 transfers rotation to an irregular shaped pulley 50 or fourth pulley. The irregular shaped pulley 50 is non-circular and is approximately a 9¾ of an inch mean diameter. In the preferred embodiment, the irregular shaped pulley 50 is egg-shaped or somewhat triangular. The shape of the irregular shaped pulley 50 can be varied and is crucial to the operation of the powered inertia propelled screed 10. The shape of the irregular shaped pulley 50 is necessary to generate a slight inertia imbalance when the irregular shaped pulley 50 rotates. The irregular shaped pulley 50 is mounted on an axle 51. The axle 51 is approximately $\frac{7}{8}^{th}$ of an inch internal diameter and is stationary, and the irregular shaped pulley 50 rotates around the axle 51. FIG. 2 illustrates the axle 51 mounted to a bracket 52. The bracket 52 is mounted to the platform 30. The axle 51 extends transverse from the bracket 52 through the irregular shaped pulley 50. The axle 51 allows the irregular shaped pulley 50 to rotate. The end of the axle 51 not fixed to the bracket 52 has a cotter pin 60 attached to the axle 51 to prevent the irregular shaped pulley 50 from rotating off of the axle 51.

A spacer 53 is connected to the irregular shaped pulley 50 opposite the side of the irregular shaped pulley 50 that is nearest the bracket 52. The spacer 53 is horizontal and is not through the center of the irregular shaped pulley 50 rather the spacer 53 is located toward the outside perimeter of the irregular shaped pulley 50. The spacer 53 is rotatably connected to an arm 54 with a ¾$^{th}$ of an inch stop nut 90. The spacer 53 holds the arm 54 away from the irregular shaped pulley 50 so that when the arm 54 rotates, the arm 54 clears the axle 51 and cotter pin 60. The arm 54 can be a pipe, bar or rod. The arm 54 is one inch in diameter, preferably aluminum and transverse to the spacer 53. As the irregular shaped pulley 50 rotates, the spacer 53 and arm 54 move along with the irregular shaped pulley 50. Strap irons 80 are attached to both sides of the irregular shaped pulley 50 for strength, stability and a bearing surface for the irregular shaped pulley 50.

Figure 1A:
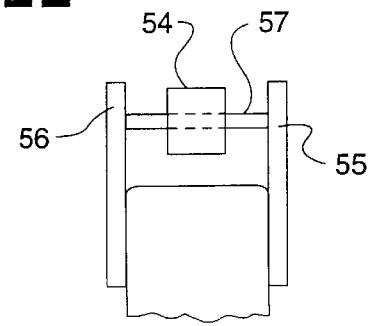
FIG. 1A illustrates a side view of the arm and the left and right V-shaped stationary brackets.

The end of the arm 54 opposite the end indirectly connected to the spacer 53 is connected to a left v-shaped stationary bracket 55 and right v-shaped stationary bracket 56, each of which can be two separate brackets. The arm 54 is rotatably mounted between the left and right v-shaped stationary brackets 55, 56 with a small axle 57 as shown in FIG. 1A. The small axle 57 is transverse with the left and right stationary brackets 55, 56 and stationary; however, a hole in the arm 54 allows the arm 54 to rotate when mounted between the left and right v-shaped stationary brackets 55, 56. The end of the arm 54 attached to the small axle 57 is free to rotate around the axle 57 axis. The ends of the left and right v-shaped stationary brackets 55, 56 opposite the ends attached to the small axle 57 are permanently attached to the screed 11. The rotation of the irregular shaped pulley 50 will result in the powered inertia propelled screed 10 being moved back and forth along the tracks 21. The arm 54 attached to the left and right v-shaped stationary brackets 55, 56 is not free to move towards or away from the irregular shaped pulley 50 thus the powered inertia propelled screed 10 moves back and forth.

Figure 5:
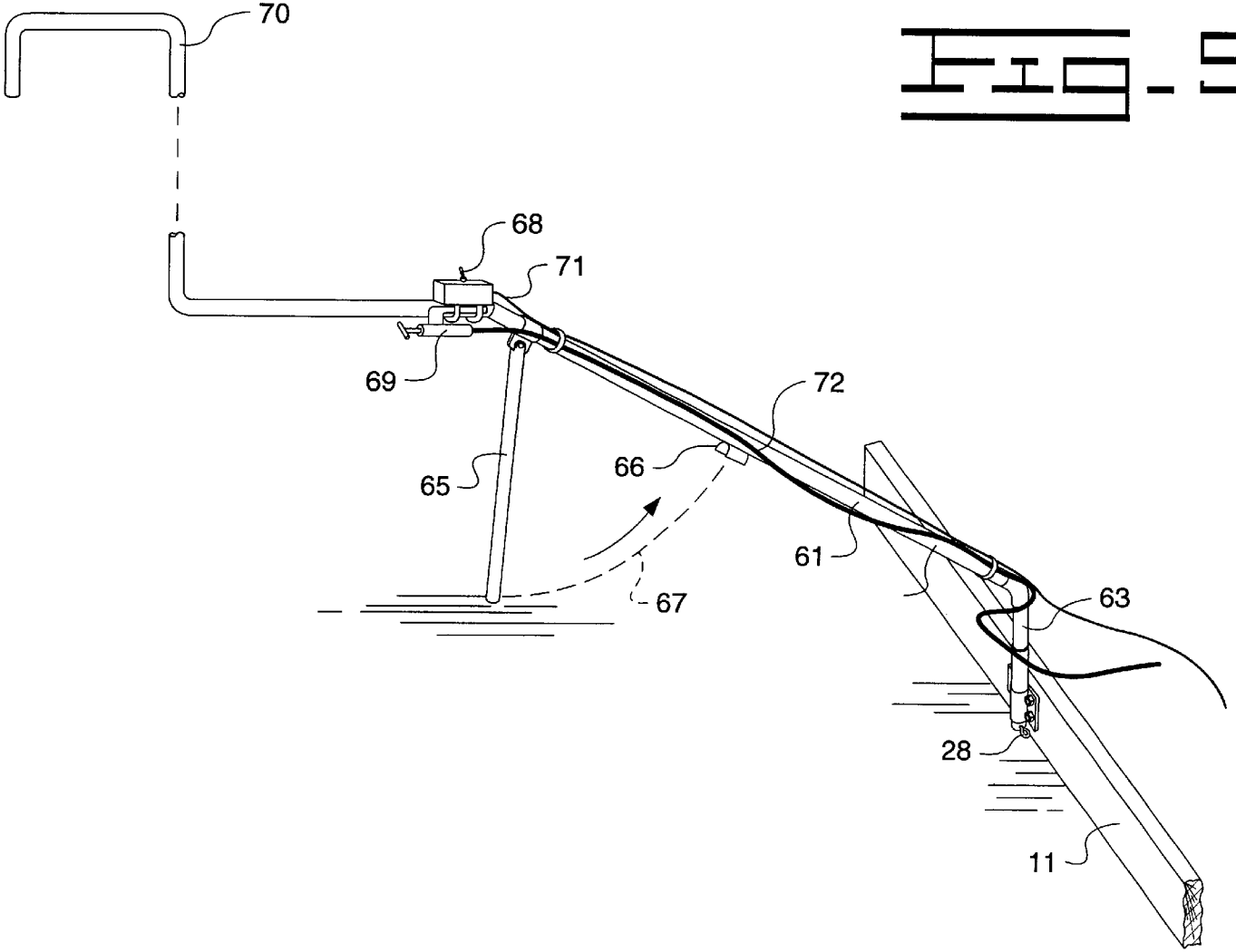
FIG. 5 illustrates a side view of a left control arm of the powered inertia propelled screed apparatus.
Figure 6:
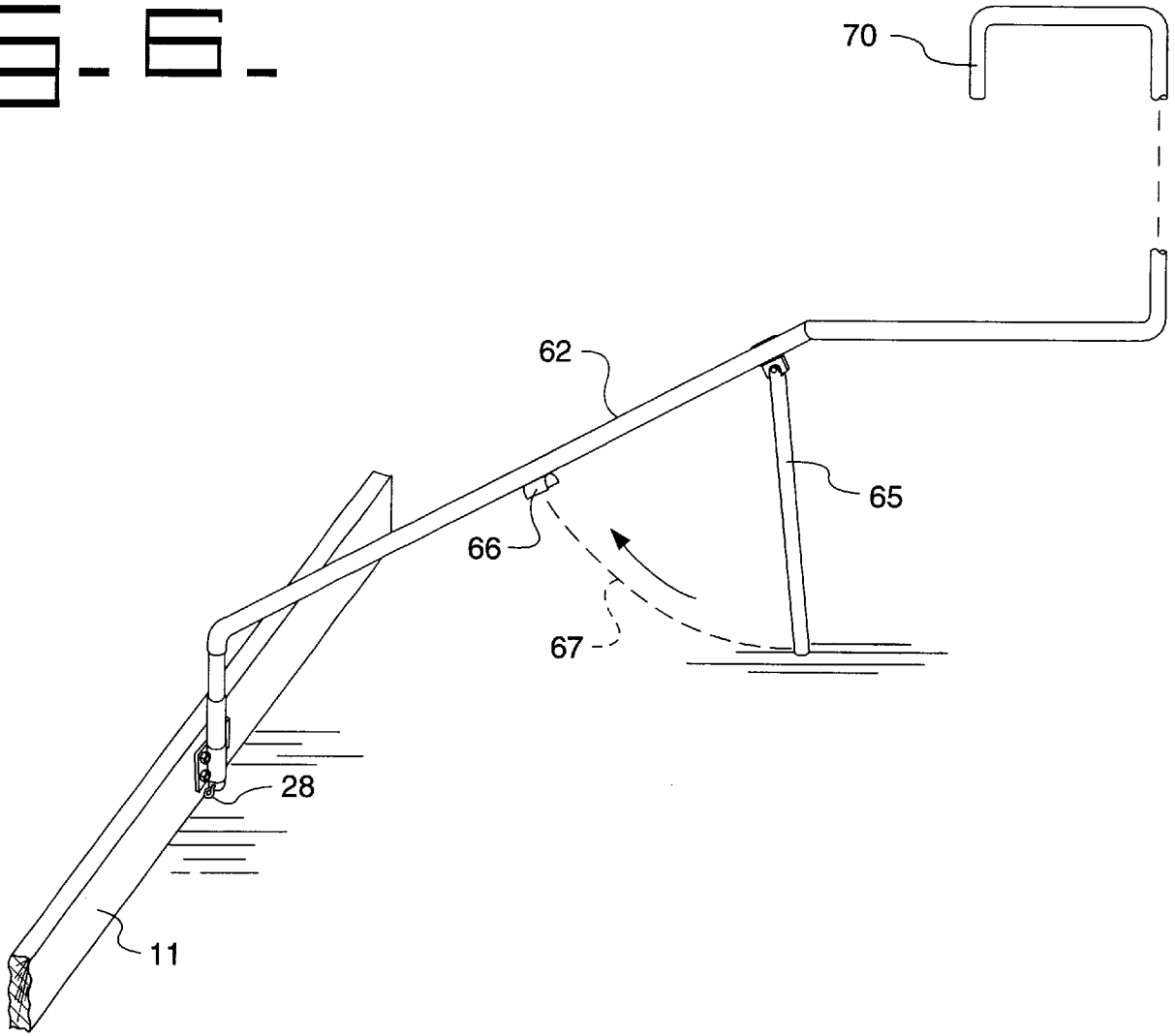
FIG. 6 illustrates a side view of a right control arm of the powered inertia propelled screed apparatus.

FIGS. 5 and 6 illustrate a left and right control arm 61, 62, respectively. The control arms 61, 62 have first ends 63 that are connected to the screed 11. Second ends 64 of the control arms 61, 62 are transverse to the first ends 63 and extend upwardly with respect to the ground. Park props 65 are attached transverse to the second ends 64 of the control arms 61, 62 for supporting the control arms 61, 62 when the powered inertia propelled screed 10 is not in use. The park props 65 attached to the second ends 54 are rotatably connected to the control arms 61, 62 so that the park props 65 can be moved parallel to the control arms 61, 62 when the powered inertia propelled screed 10 is in use. Fasteners 66 are used to hold the park props 65 parallel to the control arms 61, 62 when the powered inertia propelled screed 10 is in use. When not in use, the park props 65 are unfastened from the fasteners 66 so that the ends of the park props 65 not connected to the control arms 61, 62 are put into contact with the ground to support the powered inertia propelled screed 10 in a park position. Paths of travel 67 of the park props 65 are illustrated. A stabilizer 70 is removably connected to the left control arm 61 and the right control arm 62 when it is desirable for one person to operate the powered inertia propelled screed 10. The stabilizer 70 can be removed when two people are available to run the powered inertia propelled screed 10.

A power switch 68 is attached to either the left or right control arm 61, 62. The power switch 68 is connected to a power cable 71. The power cable 71 is connected to the power source 40. The power switch 68 is used to turn the power to the power source 40 on and off. A throttle control 69 is attached to either the left or right control arm 61, 62. The throttle control 69 is connected to a throttle cable 72. The throttle cable 72 is connected to the idler pulley 44 and is used to control the speed of the back and forth movement of the powered inertia propelled screed 10 in or on the tracks 21. The throttle control 69 is a choke or throttle control such as the throttle controls used for a power motor.

To operate the powered inertia propelled screed 10, the user fastens the park props 65 to the fasteners 66 while holding the stabilizer 70. The user turns on the power source 40 by the power switch 68. When power is supplied to the power source 40, the motor pulley 41 will begin to rotate. The motor pulley 41 causes the motor belt 42 to rotate around the speed reduction pulley 43. The speed reduction pulley 43 rotates and the transfer axle 45 transfers the rotation to the second speed reduction pulley 46. The second speed reduction pulley 46 rotates and causes the continuous belt 49 to rotate around the irregular shaped pulley 50.

Figure 3:
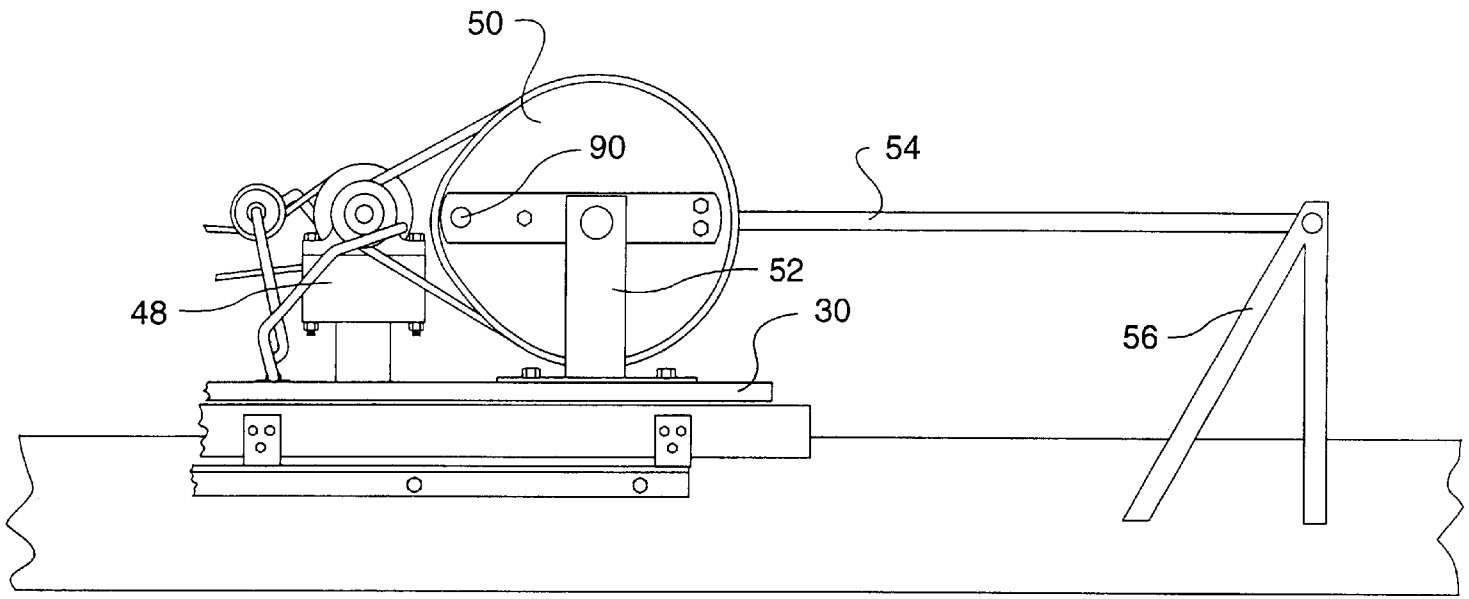
FIG. 3 illustrates an enlarged front side view of an irregular shaped pulley in a first position that produces the oscillating movement of the powered inertia propelled screed apparatus.
Figure 4:
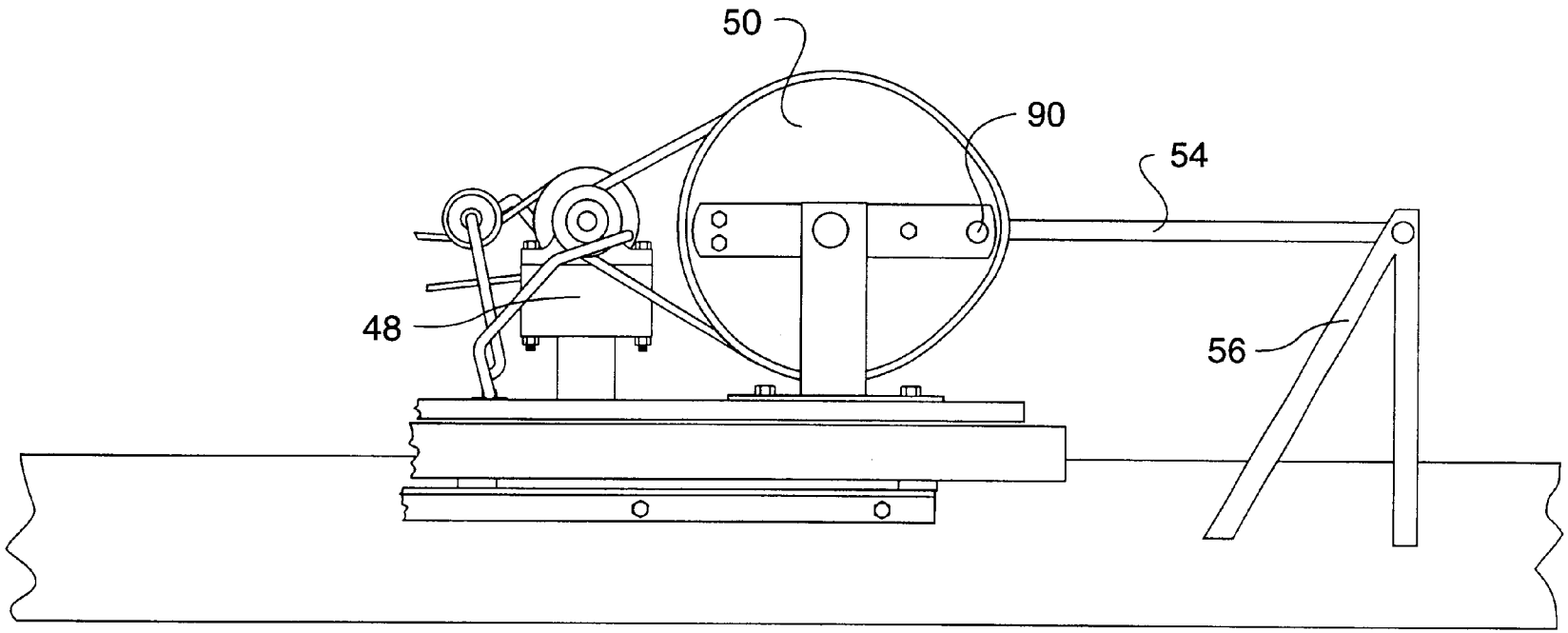
FIG. 4 illustrates an enlarged front side end of the irregular shaped pulley in a second position that produces the oscillating movement of the powered inertia propelled screed apparatus.

The irregular shaped pulley 50 will start to rotate around the axle 51. As the irregular shaped pulley 50 rotates, the platform 30 mounted operatively to the wheels 33 and all the components which create the mass mounted on the platform 30 will be moved in a back and forth motion along the tracks 21. As the irregular shaped pulley 50 rotates, the end of the arm 54 attached operatively to the irregular shaped pulley 50 is moved in an irregular circular motion as defined by the shape of the irregular shaped pulley 50. Because the arm 54 is mounted to the left and right v-shaped stationary brackets 55, 56 and cannot move towards or away from the irregular shaped pulley 50 during the rotation of the irregular shaped pulley 50, the platform 30 mounted indirectly to the wheels 33 is forced to move along the tracks 21 in a back and forth or oscillating movement. Specifically, the back and forth movement is created by the location of the arm 54 with respect to the irregular shaped pulley 50. FIG. 3 illustrates the irregular shaped pulley 50 in a first position. In the first position, the powered inertia propelled screed 10 is moved closer to the v-shaped stationary brackets 55, 56. The powered inertia propelled screed 10 is moved along the tracks 21 as the irregular shaped pulley 50 rotates because the arm 54 length is not varied or moved towards or away from the irregular shaped pulley 50. As the powered inertia propelled screed 10 rotates from the first position to a second position as illustrated in FIG. 4, the powered inertia propelled screed 10 is moved away from the v-shaped stationary brackets 55, 56. When the irregular shaped pulley 50 is rotated, the powered inertia propelled screed 10 moves back and forth and causes the screed 11 to move back and forth across the concrete. The movement of the irregular shaped pulley 50 causes changes in direction of the mass of the powered inertia propelled screed 10 and inertia is generated in opposing directions. The weight of the powered inertia propelled screed 10 is moved or jolted back and forth. The inertia causes the back and forth movement of the powered inertia propelled screed 10. Inertia in substantially equal and opposite direction is created by the rotation of the irregular shaped pulley 50. The irregular shaped pulley 50 causes a slight inertia imbalance when the irregular shaped pulley 50 is rotated. The change in the irregular shaped pulley's 50 diameter causes a change in speed and forces acting on the powered inertia propelled screed 10. This change in speed and forces causes inertia to act on the powered inertia propelled screed 10. Once again, in one instance the powered inertia propelled screed 10 is in the first position as shown in FIG. 3 which propels the screed 11 to the right. In another instance, the powered inertia propelled screed 10 is in the second position as shown in FIG. 4 which propels the screed 11 to the left which is approximately 180 degrees from the first position. The movement of the irregular shaped pulley 50 from the first to the second position caused the weight of the powered inertia propelled screed 10 to be moved or jerked causing the screed 11 to the left when moving from the right to the left. Of course, there are more than two positions for the irregular shaped pulley 50 and the first and second positions are described for illustration purposes. The powered inertia propelled screed 10 moves back and forth along the tracks 21 because of the forces generated from the irregular shaped pulley 50. The back and forth movement is abrupt and causes a jerking movement. As the powered inertia propelled screed 10 is moved back and forth, so moves the screed 11. The screed 11 is moved back and forth when the irregular shaped pulley 50 is rotated. The screed's 11 back and forth movement is utilized to level, smooth or spread concrete. The back and forth movement helps to force large particles down into the concrete. As the powered inertia propelled screed 10 is operating, the user pulls or moves the powered inertia propelled screed 10 along the concrete so that the screed 11 contacts, levels and spreads the concrete.

The throttle control 69 is used to vary the speed of the power source 40. The speed of the power source 40 will dictate the rotational speed of the irregular shaped pulley 50. The rotational speed of the irregular shaped pulley 50 dictates the speed of the back and forth movement of the powered inertia propelled screed 10. The speed of the back and forth movement of the powered inertia propelled screed 10 dictates the speed of the back and forth movement of the screed 11. The user can control the screed 11 by varying the power source 40 speed.

Other objects, features, advantages and applications will be apparent to those skilled in the art. While preferred embodiments of the present invention have been illustrated and described, this has been by way of illustration and the invention should not be limited except as required by the scope of the appended claims.

What is claimed is:

1. A powered inertia propelled screed having a screed for leveling, smoothing and spreading material, comprising:

a power source;

a platform, having a top portion and a bottom portion, wherein the power source is connected to the top portion of the platform;

a first pulley rotatably connected to the power source;

a transfer axle rotatably connected to the top portion of the platform;

a second pulley, wherein the second pulley is connected to the transfer axle;

a first continuous belt operatively connected between the first pulley and the second pulley;

a third pulley, wherein the third pulley is connected to the transfer axle;

a fourth pulley, wherein the fourth pulley is rotatably connected to the top portion of the platform;

a second continuous belt operatively connected between the third pulley and the fourth pulley;

an arm operatively attached to the fourth pulley; and at least one stationary bracket connected to the screed and the arm, wherein when the power source rotates the first pulley to move the continuous belt that rotates the second pulley to move the arm that moves the powered inertia propelled screed back and forth causing the screed to move back and forth.

2. A powered inertia propelled screed according to claim 1, further including a plurality of wheels operatively attached to the bottom portion of the platform; and a plurality of tracks for receiving the plurality of wheels; wherein when the powered inertia propelled screed can move back and forth along the tracks causing the screed to move back and forth.

3. A powered inertia propelled screed according to claim 2, further including a left and right control arm operatively connected to the powered inertia propelled screed, wherein the screed is controlled to level, smooth and spread material.

4. A powered inertia propelled screed according to claim 3, further including:

a toggle control mounted on either the left or right control arm for varying the speed of the power source wherein controlling the speed of the power source also controls the back and forth movement of the screed.

5. A powered inertia propelled screed according to claim 1, wherein the fourth pulley is irregularly shaped.

6. A powered inertia propelled screed according to claim 1, further including a power switch for turning power to the power source on or off.

7. A powered inertia propelled screed according to claim 1, wherein the second pulley and the third pulley provide speed reduction.

8. A powered inertia propelled screed according to claim, 1, further including:

a fifth pulley and wherein the fifth pulley is an clutch.

* * * * *